United States Patent [19]

Luther et al.

[11] 4,159,678

[45] Jul. 3, 1979

[54] PROPELLANT CHARGE CASING

[75] Inventors: Hans-Werner Luther, Kaarst; Peter Bender, Düsseldorf, both of Fed. Rep. of Germany

[73] Assignee: Rheinmetall G.m.b.H., Düsseldorf, Fed. Rep. of Germany

[21] Appl. No.: 833,713

[22] Filed: Sep. 15, 1977

[30] Foreign Application Priority Data

Sep. 16, 1976 [DE] Fed. Rep. of Germany ..... 26416659

[51] Int. Cl.[2] ..... F42B 5/26

[52] U.S. Cl. ..... 102/44; 102/DIG. 1; 102/38 CC

[58] Field of Search ..... 102/38 CC, 44, 45, DIG. 1

[56] References Cited

U.S. PATENT DOCUMENTS

| | | | |
|---|---|---|---|
| 2,818,021 | 12/1957 | Boehm et al. | 102/44 |
| 3,026,802 | 3/1962 | Barnet et al. | 102/44 |
| 3,749,023 | 7/1973 | Kawaguchi et al. | 102/DIG. 1 |

FOREIGN PATENT DOCUMENTS

| | | | |
|---|---|---|---|
| 87428 | 6/1966 | France | 102/44 |

(Addition to No. 1349818

*Primary Examiner*—Verlin R. Pendegrass

[57] ABSTRACT

A casing for a projectile that includes a combustible propellant container is improved by the addition of a flexible spring steel bearing plate that includes a number of holes for the purpose of facilitating combustion of the propellant container and a number of radial slits to increase the plate's flexibility.

5 Claims, 3 Drawing Figures

FIG.1
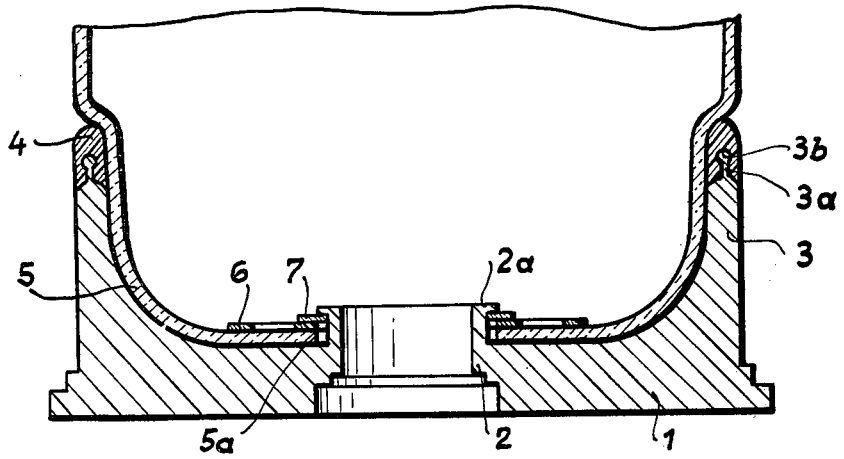
FIG.2
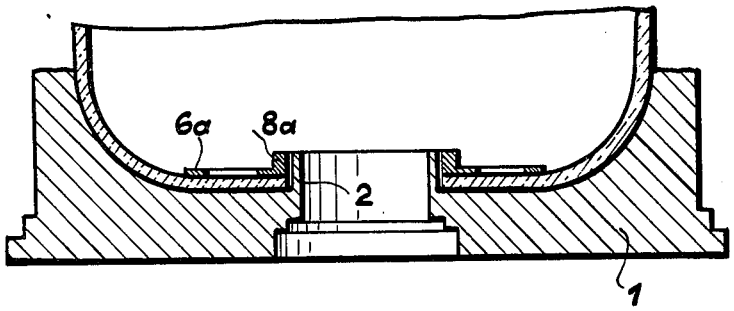
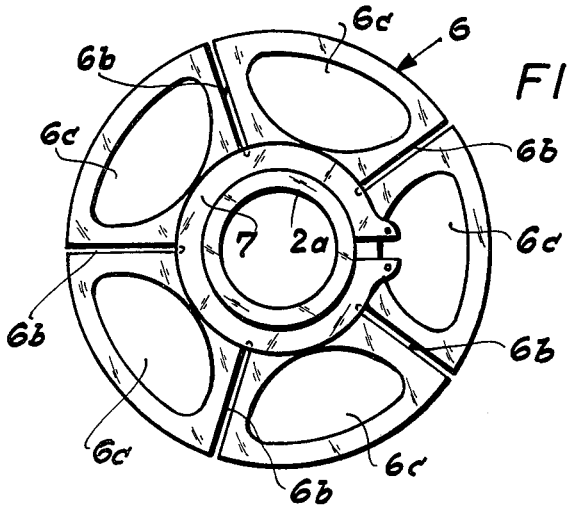
FIG.3

PROPELLANT CHARGE CASING

BACKGROUND OF THE INVENTION

It is known in the art of projectile manufacture to employ a securing device to attach a combustible propellant container to a rigid base that fits within a weapon barrel. Prior art devices, however, suffered from incomplete combustion, as that part of the combustible propellant container covered by the securing device did not burn, and the securing device used was stiff and inflexible. (See German patent DT-PS No. 1,453,842.)

SUMMARY OF THE INVENTION

The invention relates to an improvement on a case for a projectile, in which a combustible propellant container is connected with a base by means of a flexible bearing plate that is attached to a socket for a primer cap.

One feature of the invention is the provision of apertures in the flexible bearing plate to facilitate the combustion of the combustible propellant container.

Another feature of the invention is the provision of radial slits in the bearing plate in order to absorb radial forces on the propellant container.

Further features and advantages of the invention will become apparent through study of the following detailed description and accompanying drawing.

BRIEF DESCRIPTION OF THE DRAWING

FIG. 1 shows a cross section of the lower portion of one embodiment of the invention.

FIG. 2 shows a cross section of the lower portion of a second embodiment of the invention.

FIG. 3 shows a plan view of the embodiment shown in FIG. 1.

DETAILED DESCRIPTION OF THE DRAWING

In FIG. 1, base 1 is formed from a sturdy, non-combustible material, illustratively brass, that is shaped to fit in a weapon barrel. On the inside, base 1 is contoured to accomodate propellant container 5 which is made of a flexible combustible material. Container 5 is connected to base 1 by fastener 2, which passes through an aperture in container 5, and by bearing plate 6 and circular retaining clip 7. Illustratively, fastener 2 comprises a bushing projecting inward from base 1 that is open to the outside of base 1 and is internally threaded to receive a standard primer cap (not shown).

Bearing plate 6 covers the aperture in container 5 and extends outward to press the flexible material of container 5 into the contours of base 1. Plate 6 is held in place by circular retaining clip 7, which fits between plate 6 and flange 2*a* on the top of fastener 2. The upper portion of case 1 is formed into a rim 3 having a lip 3*a* that is shaped in projection 3*b* to form a snap connector with an annular resilient packing ring 4 which is contoured to mate with projection 3*b*. Ring 4 may be rubber, silicone rubber, or plastic.

FIG. 2 shows an alternate fastening device for connecting container 5 with case 1. In that case, flange 2*a* and clip 7 are eliminated, and plate 6*a* has an internally threaded bushing 8*a* that screws onto threads in the exterior of fastener 2.

In FIG. 3, a plan view of plate 6 shows two of the most important features of the invention. A plurality of apertures 6*c* in plate 6 facilitate the combustion of container 5, as compared with retaining means used in the prior art, and a plurality of radial slits 6*b* increase the flexibility of plate 6, enabling it to give in response to stress forces exerted on it by container 5, moving within the limits set by the flexibility of resilient packing ring 4. The result of the flexibility of plate 6 is that container 5 may move laterally relative to the base without damage to itself or to fastener 2.

Further embodiments of the invention are the use of a nut in place of circular retaining clip 7 and flange 2*a*, the nut engaging threads on fastener 2; or forming plate 6 as a circular retaining clip instead of having two separate elements.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. A casing for a propellant comprising:

a cylindrically symmetric base having a muzzle end and a primer end, in which said base includes a rim extending out from said primer end, forming a cup and ending in a lip, and in which base, said primer end includes axially centered means for connecting a primer cap, a combustible charge container disposed within said cup formed by said rim, and having an aperture through which said means for connecting a primer cap extends, a resilient bearing plate member disposed about said means for connecting a primer cap and within said combustible container, said resilient bearing plate is formed from spring steel, has a plurality of apertures extending therethrough and has a plurality of radial slits extending inward from a periphery, and fastening means for attaching said resilient bearing plate to said means for connecting a primer cap, whereby said combustible propellant case is confined within said base.

2. A casing according to claim 1, in which said fastening means includes a circular retaining ring.

3. A casing according to claim 1, in which said fastening means includes a nut engaging threading on said means for connecting a primer cap.

4. A casing according to claim 1 in which said fastening means includes a bushing formed in said flexible bearing plate and threaded to engage threading on said means for connecting a primer cap.

5. A casing according to claim 1 in which said bearing plate forms a circular retaining ring.

* * * * *